United States Patent [19]

Storrs

[11] 3,985,637

[45] Oct. 12, 1976

[54] PROCESS FOR SEPARATING AND RECOVERING LIQUID PRODUCTS FROM SOLID AND LIQUID SUBSTANCES

[76] Inventor: Kindred L. Storrs, 881 Second Ave., Salt Lake City, Utah 84103

[22] Filed: May 22, 1974

[21] Appl. No.: 472,431

[52] U.S. Cl. ..... 208/8; 208/11 R; 208/106; 201/24; 201/25; 201/32; 202/117; 432/121

[51] Int. Cl.[2] ..... C10G 1/02

[58] Field of Search ..... 208/11, 8; 201/18, 21, 201/24, 25, 32; 202/117; 432/121

[56] References Cited

UNITED STATES PATENTS

| | | | |
|---|---|---|---|
| 2,809,154 | 10/1957 | Storrs | 201/5 |
| 3,325,395 | 6/1967 | Ban | 201/32 |
| 3,475,279 | 10/1969 | Bowman | 208/8 |
| 3,483,115 | 12/1969 | Haddad et al. | 201/32 |
| 3,560,368 | 2/1971 | Rowland et al. | 208/11 |
| 3,761,359 | 9/1973 | Von Hippel | 208/11 |

*Primary Examiner*—Delbert E. Gantz
*Assistant Examiner*—James W. Hellwege
*Attorney, Agent, or Firm*—Mallinckrodt & Mallinckrodt

[57] ABSTRACT

A substance to be treated for the production therefrom of useful products (usually decomposition products) is formed into a bed on a perforate support, the bed having a thickness of up to about one inch. An inert atmosphere is maintained above and in contact with the bed in a substantially closed space of constant volume. The bed is heated to progressively increasing temperatures by means of a radiant heat source located in the closed space at a distance of up to one and one-half inches above the upper surface of the bed. As the bed is heated, liquid products are educted from the substance and are removed by the force of gravity from the bottom of the bed through the perforate support.

11 Claims, 4 Drawing Figures

PROCESS FOR SEPARATING AND RECOVERING LIQUID PRODUCTS FROM SOLID AND LIQUID SUBSTANCES

BACKGROUND OF THE INVENTION

Field

This invention pertains to process and apparatus for producing various liquid products from a substance by heat treatment, and particularly to process and apparatus involving education of constituents of a substance, as liquids, by heat treatment and gravity separation.

State of the Art

Decompostion products are customarily obtained from various hydrocarbonaceous substances, such as coal, oil-bearing shales, petroleum, etc., by a process of distillation, involving the heating of the substance to at least the boiling points of the respective products desired, whereupon they are removed in the form of vapors and gses. Following their removal, the vapors and gases are subjected to condensation procedures.

In my U.S. Pat. No. 2,809,154, process and apparatus are disclosed for heating a substance to temperatures no greater than will result in the release of recoverable constituents from the material in the form of liquids, rather than vapors, the liquids being removed from the substance by the force of gravity. This patented process has effected considerable savings in heat compared with customary distillation processes, but, in accordance with the present invention, has been found to be susceptible to significant and surprising improvement by reason of maintaining certain parameters critical to the obtaining of improved results in terms of still greater saving in processing heat required and greatly improved yields of useful, liquid products.

SUMMARY OF THE INVENTION

In accordance with the present invention, an improved process, i.e., method, is provided for the heat treatment of both liquid and solid substances to educt and recover useful products therefrom. The process comprises forming the substance to be treated into a elongate, substantially horizontal bed supported on a perforate support. A substantially closed space of substantially constant volume is maintained above the bed. A inert atmosphere, which will not support combustion of the substance making up the bed, is contained in the closed space in contact with the bed of material being treated.

The substance, i.e., bed of material, is heated to progressively increasing temperatures by means of a radiant heat source located at the top of the closed space. As the bed is heated, useful liquid products, usually decomposition products, form throughout the substance being treated and are removed by the force of gravity from the bottom side of the bed through the perforate support. The liquid, liquid droplets, and any gaseous material derived from the heat treatment of the substance are conducted away from th underside of the perforate support by suitable gravity-flow conduits leading downward to one or more collection chambers.

Pursuant to the present invention, it has been found that unexpected improvements in yields of liquids educted from the substance being treated, can be obtained, together with greatly decreased heat consumption, by providing a closed space of substantially constant volume above the bed and maintaining a substantially static, inert atmosphere in the closed space. The inert atmosphere, which is in contact with the upper surface of the bed, is maintained in a substantially static condition by controlling a particular combination of process variables within specified critical ranges as described hereinafter.

The substance being treated is formed into a substantially horizontal bed having a thickness of up to about 1 inch, preferably from about ½ inch to about 1 inch. The bed is heated to progressively increasing temperatures by the radiant heat source which is located up to about 1½ inches above the upper surface of the bed, preferably from about three-eights inch to about 1½ inches above the upper surface of the bed; the temperatures being no greater than will progressively cause liquid products to form throughtout the substance, while the atmosphere in the closed space above the bed is maintained in substantially static condition.

Preferably, the substance to be treated is formed into an elongate, substantially horizontal bed, and the bed is progressively passed through an elongate, closed space containing the radiant heat source. As the bed passes through the closed space, it progressively absorbs heat and its temperature progressively increases.

By maintaining the depth of the bed and the distance from the top of the bed to the heat source within the values given hereinbefore, the temperature of the bed can progressively be increased so that liquid eduction products form throughout the bed without releasing vapors or gases from the top of the bed. A static condition is thereby maintained in the closed space above the bed, and the liquid products so formed are removed by the force of gravity from the bottom of the bed through the perforate support. It has been found that when the thickness of the bed and/or the distance from the top of the bed to the heat source are increased beyond about 1½ inches respectively, vapors are released from the top of the bed. These vapors absorb radiant heat and are subjected to destructive cracking reactions which greatly diminish the yeild of useful, liquid products from the process. The destructive cracking reactions further consume large quantities of heat, thus, reducing the thermal efficiency of the process;

Various types of equipment may be employed in the practice of this invention, the preferred being an elongate horizontal or near horizontal enclosure closed at the top and having discharge conduits postioned longitudinally along the bottom thereof. The enclosure is divided into an upper heating chamber and a lower collection chamber by a perforated plate or screen upon which the substance to be treated is supported. Radiant heating means are positioned along the top surface of the upper chamber to heat the substance on the perforated plate or screen. The apparatus preferably has means for continuously advancing the perforated plate or screen through the enclosure, and means for introducing the substance to be treated at one end thereof and withdrawing the residue at the other end thereof.

A variety of substances, both solid and liquid, may be treated in accordance with the invention, the exact manner of handling being determined by the nature of the particular substance being treated, as can be appreciated by those skilled in the art. The knowledge requisite for determining the amount and rate of heat input to the heating zone and the rate of travel of the substance along the heating zone, is advantageously acquired by laboratory testing of the substances.

It has been found that liquid substances such as petroleum, tars, liquids derived from heat treatment of solid materials, and oils can be treated according to the present invention by supporting the liquid substances directly on a perforated plate or screen having apertures of such size that the liquid substances can be supported thereon. It has been found that the liquid decomposition products, which are formed, will separate from the liquid substance being treated and will pass through the apertures of the screen or perforated plate by the force of gravity. The liquid being treated progressively becomes more viscous and finally exits from the heat treatment as a solid, semi-solid, or very viscous liquid.

THE DRAWING

The best mode presently contemplated of carrying out the invention is illustrated in the accompanying drawings, in which:

FIG. 1 is a longitudinal, vertical section taken on the line 1—1 of FIG. 2 of one form of apparatus used in the practice of the invention:

FIG. 2, a transverse, vertical section taken on the line 2—2 of FIG. 1;

FIG. 3, a fragmentary, vertical section taken on a line corresponding to line 2—2 of FIG. 1, showing an alternative bed transport arrangement; and FIG. 4, a fragmentary horizontal section taken on line 4—4 of FIG. 3.

DETAILED DESCRIPTION OF THE ILLUSTRATED EMBODIMENTS

Figure 1:
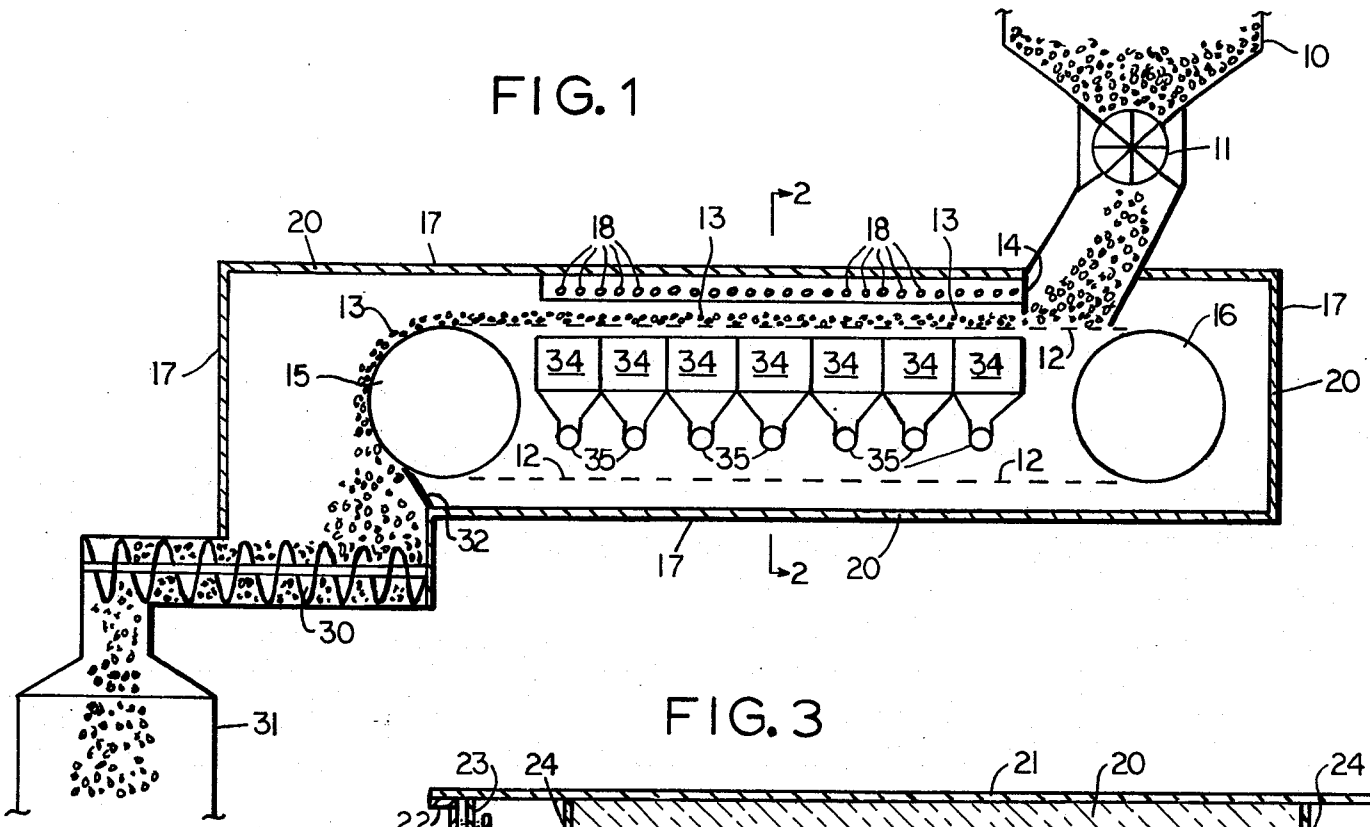

In accordance with the invention, substances to be heat treated are formed into a substantially horizontal bed which is supported on a perforate support member and has a thickness of up to about 1 inch. The lower limit of the thickness of the bed is not critical, as long as a bed is formed. Preferably, the bed has a thickness between about 178 inch and about 1 inch. A substantially closed space of substantially constant volume is maintained above the bed. The closed space contains an inert atmosphere which is in contact with the bed, and which will not support combustion of the substance making up the bed.

The bed is heated to progressively increasing temperatures by means of a radiant heat source located at the top of the closed space and spaced above the upper surface of the bed by a distance of up to 1½ inches. The bed is heated to temperatures no greater than will progressively cause liquid products to form throughout the bed while maintaining the inert atmosphere in the closed space above the bed in substantially static condition. The liquid products are removed by the force of gravity from the underside of the bed through the perforated support member. Preferably, one or more collection chambers are located below the bed, and the liquid products and any fixed gases released from the bed are conducted to such collection chambers by suitable gravity-flow conduits leading thereto. The fixed gases are released to atmospheric conditions at an opening located below the bottom side of the bed of materials, and the liquid products transported to suitable storage tanks.

The invention enables the processing of various substances such as coal, oil shale, bituminous sands, carbonaceous fossil materials, oil-bearing diatomaceous earth, asphalt, asphalt-bearing materials, tar, tar-bearing materials, crude oils, elaterite, rosselite, peat, lignite, wood, saw dust, cocoa nut shells, vegetable matter, animal manure, sewage, sewage sludge, bones, blood, and animal flesh and by-products. When the substance comprises a combustable waste material, the material should be compacted to form a dense layer of not greater than ½ inch thick.

As mentioned hereinbefore, the process of the invention is particularly useful in its ability to process heat decomposable liquids such as petroleum, petroleum fractions, gilsonite, and decomposable oils obtained from earlier heat treatment of coal, oil shale and oil sands to recover valuable liquid products therefrom. The resulting residue obtained when treating the above-mentioned solids or liquids is ideally suited for use as a non-polluting heating material.

The invention also provides for the removal of water from wet or damp materials. In drying of materials containing water, it has been found perferable to form the material into a bed having a thickness of from about ½ inch to about 1 inch. Heat is then applied to the material according to the invention, with the radiant heat source being located at a distance of from about ¾ inch to 1½ inches above the upper surface of the bed. The temperature of the material in the bed is progressively increased to substantially no greater values than those which will progressively cause water to separate from the substance in the liquid form. Such temperature should be no greater than that which causes the water separating from the material to have a temperature of between about 170°to and 200° F. The liquid water is removed from the underside of the bed by the force of gravity through the perforated support member.

In a preferred mode of operation, the substance on the perforated support member is formed into an elongated bed, and the bed is progressively passed through an elongate, closed space containing the radiant heat source, whereby the substance progressively absorbs heat and has its temperature progressively increased as it travels through the elongate, closed space.

Figure 2:
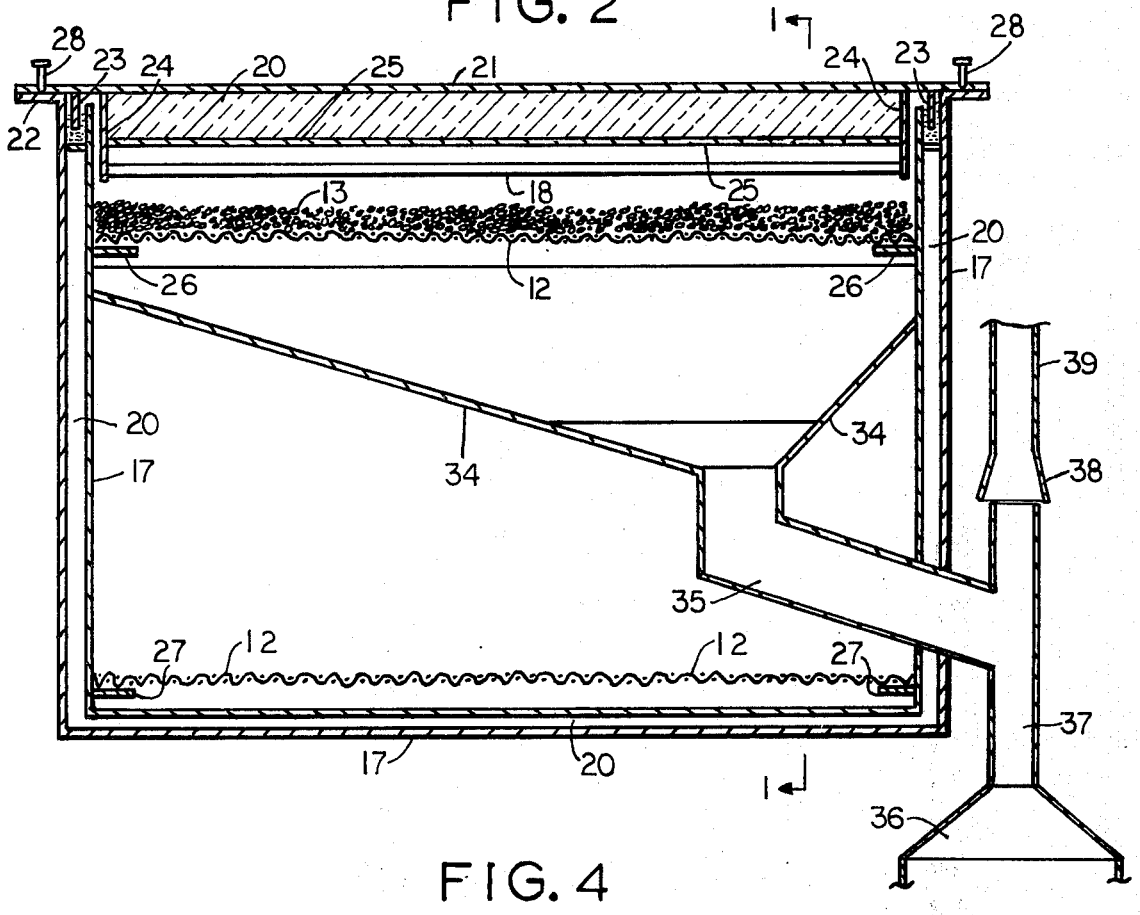

As illustrated in the drawings, a preferred form of apparatus for carrying out the present invention is arranged for continuous operation utilizing an elongate, traveling bed, with progressive withdrawal of decomposition products along the length of the traveling bed. The apparatus illustrated in FIGS. 1 and 2 is adapted to effectively carry out the method of the invention with respect to massed discrete particles of a substance, such as properly sized bituminous coals, oil shales, and the other solid substances mentioned hereinabove.

The substance to be processed, contained in vessel 10, is fed through a suitable feeder, such as a conventional rotary valve 11, onto a perforated conveyor belt 12. The substance is formed into a bed 13 of uniform depth by baffle plate 14, which extends transversely across the belt 12.

The perforated conveyor belt 12 is moved by drums 15 and 16 within an essentially air tight enclosure 17, so that the bed 13 on belt 12 progressively moves past radiant heat elements 18. The heating elements 18 are located in a substantially closed space formed by baffle plate 14 at one end of the belt 12, and the applicable portions of the sides and top of enclosure 17. The enclosure 17 is preferably double walled, having a heat insulating material 20 placed between the walls thereof. The heating elements 18 are placed adjacent to the inside wall of the top of enclosure 17, and means are provided for adjusting the height of the heating elements above the top surface of bed 13 so that when the thicknesses of bed 13 are varied within their allowable limits, the heating elements 17 can be maintained at a distance of up to one and one-half inches from the surface of bed 13. Preferably, the heating elements 18 are maintained at a distance of from three-eights to one and one-half inches from the upper surface of bed 13.

The enclosure 17 preferably has a removable top for easy access to the internal portion thereof. The upper portion of the side walls and ends of enclosure 17 are closed so as to form a continuous U-shaped channel along the upper edges thereof. This channel is filled with a liquid substance such as water. A flange 22 extends horizontally from the top edge of the sides of enclosure 17 for supporting the top portion thereof. The top portion is formed from a flat plate 21 extending from the flange 22 on one side of enclosure 17 to the flange 22 on the other side. A series of adjusting bolts 28 are positioned along the sides of plate 21 extending therethrough and resting on flange 22. The bolts 28 can be adjusted to raise or lower the top of enclosure 17 and thus raise or lower the heating elements 18 which are associated therewith.

Vertical plates 23 are attached to the perimeter of plate 21 so as to extend into the liquid substance in the U-shaped channels of enclosure 17 thereby forming an air-tight seal. A set of vertical plates 24 extend longitudinally along the sides of plate 21 so as to extend downward adjacent the internal side of the longitudinal walls of enclosure 17. Plate 25 extends parrallel to place 21 and is attached to the longitudinal plates 24. The space between plates 22 and 25 is filled with a heat insulating material. The side of plate 25 facing the bed 13 is preferably polished so as to aid in reflecting heat downwardly towards the bed 13. The heating elements 18 extend between and are supported by the plates 24. For purposes of illustration, the heating elements 18 shown are of the electrical resistance type, and are energized through a conventional electric power circuit (not shown). Other radiant heating means are well known in the art and could be substituted for the electrical heating elements. For example, insulation could be applied to the top of plate 21 and hot combustion gases circulated between plates 21 and 25 whereupon plate 25 itself would radiate heat to bed 13.

As illustrated, the perforated belt 12 is made up of woven wire screen or mesh sufficiently fine to retain the bed 13 being treated thereon. The mesh must be determined in any given instance by the nature of the substance being processed. In the case of treating a liquid substance, as will be discussed hereinafter, it has unexpectedly been found that mesh screens having a very fine mesh size will support the liquid substance being treated, while still permitting free passage therethrough of the liquid products being released therefrom.

The edges of belt 12 are supported by longitudinal platens 26 and 27 affixed to respective longitudinal side walls of enclosure 17. The platens enable the belt 12 to move freely without vibrating the bed 13 of material. The belt 12 is mounted on drums 15 and 16, FIGS. 1 and 4, with one of the drums being driven by suitable drive means (not shown in drawings).

The substance to be treated is fed onto belt 12, in the form of a bed 13 having a thickness of up to about 1 inch, preferably from about ½ inch to about 1 inch. The bed 13 progressively moves past the heating elements 18, and a substantially closed space of substantially constant volume is maintained above the bed 13. The close space being formed by the side walls and top enclosure 17, and the bed 13 itself, with the distance between the top surface of bed 13 and the radiant heat elements 18 being adjusted by means of bolts 28 in plate 21. The bed 13 progressively absorbs radiant heat as it moves past the heating elements 18, resulting in a progressive increase in the temperature of the substance being treated. The progressive increase in temperature of the substance can be accelerated by adjusting the temperature of the individual heating elements so that they progressively increase in temperature in the direction of travel of the belt. In view of operating simplicity, the temperatures of the heating elements are preferably held constant, and the increase in temperature of bed 13 is due to progressive absorption of radiant heat as it passes through the heating zone.

The substantially closed space of the retort zone of the apparatus shown, will contain atmospheric air during initial start-up. Very quickly, the oxygen content of the air is depleted due to reaction with some of the material in the bed 13. After this initial, small period of time, the space in the retort zone contains a substantially inert atmosphere which is in contact with the bed 13 of material, and which will not support combustion of any of the materials in the bed 13.

The char discharged from the retort zone falls from belt 12 as the belt reverses its direction of travel around drum 15. The char drops into a suitable conveyor, such as the screw conveyor 30 which is positioned at the discharge end of enclosure 17. The char is conveyed to a storage bin 31. A doctor blade 32 can be positioned as shown in FIG. 1 to remove any material which tends to adhere to belt 12 as it passes over drum 15.

As the substance making up bed 13 passes through the heating zone, decomposition products are progressively derived in accordance with the progressive temperature rise of the substance. The progressive rise in the temperature in bed 13 results in a progressive release of a variety of liquid products, usually decomposition products, which separate from bed 13 and are removed therefrom through the perforated belt by the force of gravity.

It is a feature of the method of this invention, and of the apparatus here disclosed for practicing the method to best advantage, that the decomposition products are produced as liquids, and the liquids are recovered from the points of information in the bed 13 substantially without diminuation in density. This is accomplished by, first, permitting the substance to absorb at any given time substantially only that quantity of heat required to produce a given decomposition product; second, by providing for the operation of the force of gravity upon the respective decomposition products substantially immediately upon formation; and, third, by removing such products from the zone of heat application by means of gravity and substantially without increase in volume.

In the use of the apparatus heretofore described, heat is radiated downward upon the moving bed 13 of material substantially uniformly along the length of travel of bed 13 through the retort zone. Due to the progressive absorption of heat by the bed 13, a temperature gradient is created in bed 13 along its length of travel through the retort zone. A variety of liquid products are progressively released as the temperature of the bed 13 increases. A number of separate collector means are positioned in the enclosure 17 below the perforated belt 12 to collect the released, liquid products. As shown in the drawings, the collector means comprise a series of funnel-shaped vessels 34 which are located immediately below the portion of the perforated belt 12 in the heating zone. Liquid products released from the bed 13 of material gravitate through the perforated belt 12 and fall into the respective collector vessels 34. Respective conduits 35 conduct the received, liquid products to suitable tanks for storage, or elsewhere as may be found desirable.

According to the method of the invention, an initial refining of the released liquid products is obtained simultaneously with the separation of the products from the substance being treated. The products released from the substance in the moving bed have progressively higher boiling points as the temperature of the substance increases. Thus, the liquid products collected in the first in the series of collector vessels 34 has a lower boiling point than the product collected in the next vessel in line. The product collected in the second vessel, in the series of vessels 34, has a lower boiling point than that collected in the third vessel in the series, and so on down the line of vessels 34.

Pursuant to the invention, a decreased consumption of heat together with greatly improved yields of the liquid products are obtained by controlling particular process variables within specified critical ranges. By operating within such critical ranges, the inert atmosphere in the closed space above the bed 13 is maintained in a substantially static condition, i.e., there is substantially no transfer of vapors or gases from the bed to the closed space. Any fixed gases generated in the substance during the heat treatment are removed with the liquid decomposition products from the bottom of the bed 13. By maintaining the depth of the bed 13 no greater than about one inch, and by spacing the heat source from the upper surface of the bed 13 by no more than about one and one-half inches, the substance making up the bed 13 can be heated progressively to temperatures no greater than will cause the liquid products to form, without vaporizing any of the liquid products from the top of the bed, or otherwise releasing any gases from the top of the bed. A substantially static condition is then maintained in the closed space above the bed, and the liquid products produced, along with any fixed gases which are generated, are removed from the bed through the perforated belt by the force of gravity. When the depth of the bed or the distance from the surface of the bed to the heating means exceeds the above-mentioned limits, vapors begin to distil from the top of the bed and migrate into contact with the radiant heating means. Such vapors are subjected to destructive cracking reactions which greatly diminish the yield of useful liquid products from the process. The cracking reactions further consume large quantities of heat, and the heating means becomes encased in degradation products which further reduce the thermal efficiency of the process.

It has, further, been found that withdrawing fixed gases, together with the liquid products, from the bottom of bed of materials, and then releasing the fixed gases to atmospheric conditions at a point below the bottom side of the bed, aids in maintaining a static condition in the closed space above the substance being treated. As shown in FIG. 2, the fixed gases and liquid products released from the bed 13 are withdrawn through respective conduits 35. The liquid products are conducted to respective storage tanks 36. A vent pipe

37 allows the fixed gases to be released to atmospheric conditions. The released gases are collected by a hood 38 and conducted by associated piping for disposal or further processing of the fixed gases. Withdrawal of the fixed gases from the retort has been found to be greatly enhanced when they are released to atmospheric conditions at a point below the bottom side of the bed. Otherwise, the fixed gases back up in the retort and tend to migrate through the bed and into the closed space thereabove, which as explained above has been found to be highly undesirable.

It has also been found that when combustible waste materials, such as wood chips or pieces, saw dust, wastepaper, plastics, cardboard, etc. is treated according to the present invention to recover valuable liquid decomposition products therefrom, that such materials be compacted to form a dense layer of not greater than ½ inch before being subjecting to the progressive heat treatment. Sewage sludge, obtained from sewage treatment plants, can be treated according to the invention to recover valuable decomposition products therefrom.

Figure 3:
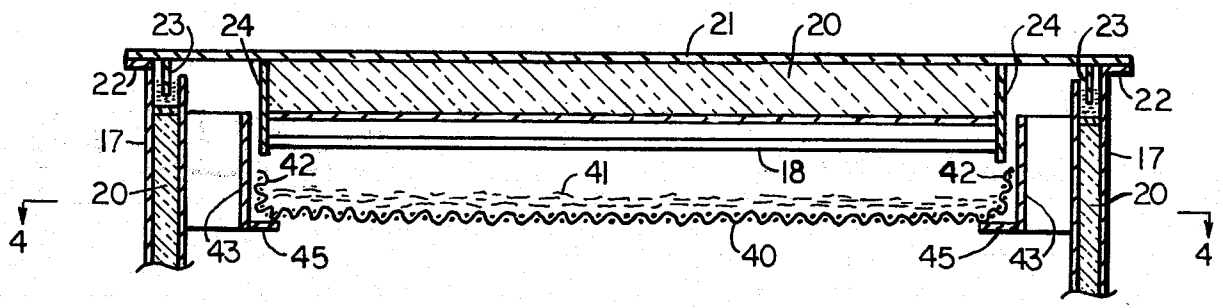
Figure 4:
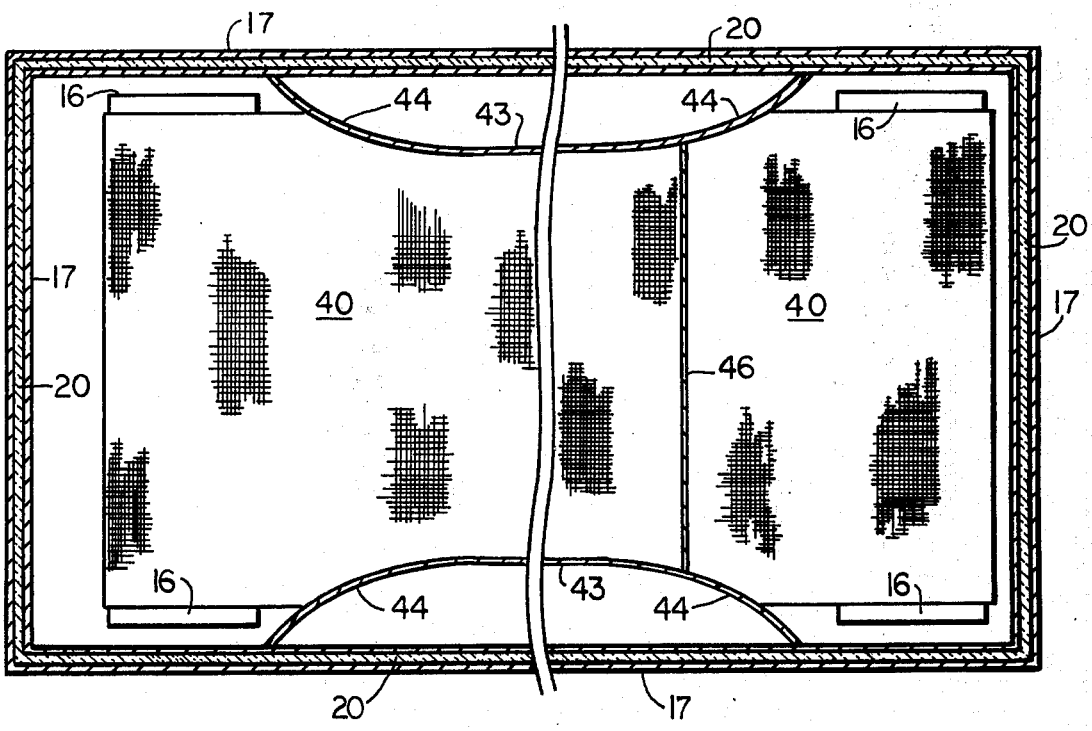

In the embodiments of FIGS. 3 and 4, the structure and arrangement of the apparatus corresponds generally to that shown in FIGS. 1 and 2. However, the perforated support means is somewhat altered for the treatment of a liquid, such as petroleum, petroleum fractions, gilsonite, tar, and the decomposition oils obtained from heat treating coal, oil shale, and oil sands. As shown in FIGS. 3 and 4, the perforated belt 40 is formed from woven wire screen having a sufficiently fine mesh to retain the liquid material which is to be treated, while still permitting free passage therethrough of the liquid products being released from the treated substance. Means are provided whereby the edges of the perforated belt 40, at least in the retort area of the apparatus are turned upward along the longitudinal sides of the apparatus as shown by the reference number 42. The upturned edges form a trough in which the liquid 41 to be treated is held.

Generally, the mesh size of the screen belt 40 must be very fine, i.e., with openings in the order of 0.05 mm to 0.001 mm or less; however, when treating very viscous fluids such as tar, gilsonite, etc. the screen size can be somewhat larger, i.e., in the order of 0.5 mm to 0.05 mm or less. It has also been found that the liquids to be treated can be supported on a thin layer of diatomaceous earth, while still permitting free passage therethrough of the liquid products being released from the treated material.

When a continuous belt is used for supporting a liquid material as shown in FIGS. 3 and 4, means must be provided for allowing the belt to lay flat as it travels around drums 16. As is best shown in FIG. 4, a preferred means for allowing the belt to lay flat as it travels around drums 16, and also forming the upturned edges on the belt as it travels past the retort section, comprises affixing flat guide rails 43 along the upper inside surfaces of the longitudinal sides of enclosure 17 between the drums 16, as shown. The end portions 44 of guide rails 43 are curved towards the sides of enclosure 17 forming convey surfaces facing the belt. Longitudinal platens are affixed to respective lower edges of guide rails 43 to support the respective edges of belt 40. The distance between the longitudinally facing portions of guide rail 43 is less than the flat width of belt 40, and, as the belt 40 moves, the edge portions 40 thereof are forced into the upstanding position as shown by reference number 42 in FIG. 3, by the first set of convex end portions 44. As the belt 40 moves past the second set of convex end portions 44, the restraining force holding the edges in an upstanding position is removed and belt 40 regains its flat shape.

In operation, the liquid material to be treated is formed as a thin layer across the belt just after the belt has passed the first set of convex end portions 44 of the guide rail 43. A dam member 46, FIG. 4, may be suspended from the top cover of the enclosure 17 so as to extend across the belt 40 between the upstanding edges 42 near the first set of convex end portions 44. A flexible seal may be affixed to the lower edge of dam 46 and which makes sealing contact with the surface of belt 40. The liquid material is fed onto belt 40 after it has passed beneath the dam 46. The dam 46 aids in forming the thin layer of liquid material on belt 40. The layer of liquid material on belt 40 progressively moves through te elongate heating section, and liquid decomposition products are removed from the bottom of the perforated belt. The liquid material on the belt progressively becomes more viscous as it passes through the heating section. As the belt emerges from the retort section, a layer of very viscous, semi-solid material or a layer of solid coke-like material is left thereon. This residue is removed from the belt 40 as it travels around drum 16. A doctor blade 32 can be used to aid in the removal of the residue from belt 40.

An important feature of the invention is that the decomposition products are formed in-situ throughout the substance in the bed as liquids are retained in their liquid state for and during removal of same from the retort, in contradistinction to conventional distillation processes where decomposition products are vaporized and cracking is unavoidable and, in fact, purposely carried on. Thus, there is no need to employ conventional condensation procedures for product recovery. Additionally, because the decompostion products are formed progressively during the treatment and are removed from the bed substantially as formed, the decomposition products are recovered as separate fractions as the process proceeds, resulting in refinement of the decomposition product simultaneously with the separation thereof from the substance being treated.

Whereas this invention is here described and illustrated with respect to certain preferred forms thereof, it is to be understood that many variations are possible without departing from the inventive concepts particularly pointed out in the claims.

What I claim is:

1. A process for educating and removing useful products from a substance, said process comprising, forming said substance into a substantially horizontal bed on a perforate support, said bed having a thickness of up to about 1 inch; providing a substantially closed space of substantially constant volume above said bed, said space containing a substantially inert atmosphere which is in contact with said bed and will not support combustion of the materials in said bed; heating the substance to progressively increasing temperatures by means of a radiant heat source located at the top of said closed space and spaced above the upper surface of said substance a distance of up to about 1½ inches, said temperatures being no greater than will progressively cause liquid and gaseous products to form substantially at the substance, while maintaining said atmosphere in said closed space in a substantially static condition; and removing the liquid and gaseous products, substantially as and when produced, from the bottom side of said bed through said perforated support to a collection chamber located below said bed, with any gases withdrawn from said bed being released from said collection chamber to substantially atmospheric conditions, and with the release opening to said atmospheric conditions being located below the bottom side of said bed.

2. A process as claimed in claim 1, wherein the radiant heat source is located at the top of the closed space from about ⅜ inch to about 1½ inches above the upper surface of the bed.

3. A process as claimed in claim 1, wherein the substance on the perforated support is formed into an elongate bed and the bed is progressively passed through an elongate closed space containing the radiant heat source, whereby the substance progressively absorbs heat and has its temperature progressively increased as it travels through said elongate space.

4. A process as claimed in claim 1, wherein the substance is selected from the group of the decomposable organic materials consisting of coal, oil-bearing shale, oil sand, oil-bearing diatomaceous earth, asphalt and asphalt-bearing materials, tars and tar-bearing material, crude oils, elaterite, gilsonite, rosselite, peat, ignite, wood, saw dust, cocoa nut shells, vegetable matter, animal manure, sewage, and sewage sludge.

5. A process as claimed in claim 1, wherein the substance is combustible waste materials which have been compacted to form a dense layer of not greater than ½ inch thick.

6. A process as claimed in claim 1, wherein the substance is a heat decomposable liquid which is capable of being supported on a perforated plate or screen.

7. A process as claimed in claim 6, wherein the substance is selected from the group consisting of petroleum, petroleum fractions, gilsonite, tar and the decomposition oils obtained from heat treatment of coal, oil shale, and oil sands.

8. Apparatus for educting and recovering useful products from a substance, said apparatus comprising, an elongate, substantially air tight enclosure having side walls and a top; means for removable coupling said top to said side walls for a substantially air tight seal therebetween; radiant heating means mounted in said enclosure adjacent said top for directing heat downwardly; a continuous, elongate, perforated belt mounted in said enclosure for movement in a substantially horizontal direction past said heating means; feed means for supplying said substance onto said belt; means for forming said substance into a bed of adjustable, predetermined thickness on said belt whereby said bed of said predetermined thickness moves in a substantially horizontal direction past said heating means and is heated by the heat being directed downward from said heating means; means for adjusting the distance between the top surface of said bed and the heating means; collecting means below the portion of said belt upon which said bed is supported for collecting liquids and any gases which are released from said bed during the heat treatment; means for conducting said liquid products from the collecting means to storage facilities; and means for releasing said gases from the collecting means to substantially atmospheric conditions, with said means for releasing said gases being located below the bottom side of said bed.

9. Apparatus as claimed in claim 8 wherein said belt comprises a woven screen having openings of about 0.5 mm or less.

10. Apparatus as claimed in claim 9 wherein means are provided for forming upturned edges on the belt as it travels past the heating elements.

11. Apparatus as claimed in claim 10 wherein the substance to be treated is a liquid and means are provided for forming a thin layer of the liquid substance on said belt.

* * * * *

UNITED STATES PATENT OFFICE

CERTIFICATE OF CORRECTION

PATENT NO. : 3,985,637
DATED : October 12, 1976
INVENTOR(S) : K. L. STORRS

It is certified that error appears in the above-identified patent and that said Letters Patent are hereby corrected as shown below:

Column 1, line 20, change "gses" to --gases--; line 46, change "A" to --An--; line 57, change "liquid, liquid" to --liquids, liquid--; and line 59, change "th" to --the--.

Column 2, line 39, change "yeild" to --yield--; and line 43, change "cess;" to --cess.--.

Column 3, line 39, change "178" to --1/2--.

Column 9, line 18, change "te" to --the--.

Claim 1, line 1, change "educating" to --educting--.

Signed and Sealed this
*twelfth* Day of *July 1977*

[SEAL]

*Attest:*

RUTH C. MASON
*Attesting Officer*

C. MARSHALL DANN
*Commissioner of Patents and Trademarks*